United States Patent [19]

Araki et al.

[11] 4,427,460

[45] Jan. 24, 1984

[54] METHOD OF MAKING MATERIAL FOR SHADOW MASKS

[75] Inventors: Kenji Araki; Masashi Kurata, both of Yokohama; Hideo Yamana; Toyoharu Suda, both of Kawasaki; Katuhiko Tayama, Yokohama; Masaji Watanabe, Idanaka, all of Japan

[73] Assignees: Nippon Kokan Kabushiki Kaisha; Nippon Mining Co., Ltd., both of Tokyo, Japan

[21] Appl. No.: 228,914

[22] Filed: Jan. 27, 1981

[30] Foreign Application Priority Data

Feb. 4, 1980 [JP] Japan ..... 55-11543

[51] Int. Cl.[3] ..... C21D 8/04

[52] U.S. Cl. ..... 148/12 C; 148/12.1

[58] Field of Search ..... 148/12 R, 12 C, 12.1, 148/36, 12.3

[56] References Cited

U.S. PATENT DOCUMENTS

| | | | |
|---|---|---|---|
| 3,510,366 | 5/1970 | Mears | 148/12.1 |
| 3,909,311 | 9/1975 | Yamada et al. | 148/36 |
| 3,959,029 | 5/1976 | Matsudo et al. | 148/12.1 |
| 4,325,752 | 4/1982 | Suda et al. | 148/12.1 |

FOREIGN PATENT DOCUMENTS

| | | | |
|---|---|---|---|
| 2942046 | 4/1980 | Fed. Rep. of Germany | 148/12.3 |
| 102224 | 8/1979 | Japan | 148/12 R |

*Primary Examiner*—Peter K. Skiff

*Attorney, Agent, or Firm*—Frishauf, Hotlz, Goodman & Woodward

[57] ABSTRACT

The present invention is concerned with a method of making material for shadow masks to be incorporated in cathode ray tubes for colour TV sets.

A coil of cold rolled low carbon Al-killed steel is forcibly decarburized through an open coil annealing until a quench aging index QAI becomes 3.0Kg/mm$^2$. This QAI is specified as follows:

$$QAI = \frac{W2 - W1}{S}$$

wherein,

W1: load (Kg) giving 10% tensile strain to the said decarburized material having been soaked at temperature of 500° C. for 10 minutes and subjected to a water cooling S: cross sectional area (mm$^2$) of a test piece when giving said 10% tensile strain W2: yield point load (Kg) provided by the strain effected material aged at temperature of 100° C. for 4 hours.

After the forcible decarburization, the steel is subjected to an ordinary re-cold rolling, photo-etching, final annealing and pressing.

7 Claims, 4 Drawing Figures

METHOD OF MAKING MATERIAL FOR SHADOW MASKS

BACKGROUND OF THE INVENTION

The present invention relates to a method of making material for shadow masks to be incorporated in cathod ray tubes for colour TV sets, which is to provide a production of ultra low carbon Al-killed steel sheet having excellent photo-etching and press forming properties.

For making shadow masks, rimmed steel is in general used (including capped steel), and passed through a series of processes of coiled cold rolled rimmed steel-ordinary annealing or decarburization annealing-temper rolling-re-cold rolling-photo-etching-cutting-annealing (final annealing)-levelling-pressing-surface treatment-setting up.

In such a process, when conventional rimmed steel is used undesirable defects become apparent during photo-etching due to non-metallic inclusions which are unavoidable in the rimmed steel. With respect to the ordinary annealed material, bad etching is caused by coarse carbide existing in the material, or difficulties arise adversely affecting the precision of holes, at pressing because of the hardness of the material.

The inventors have already proposed, in Japanese Patent Application No. 53-133,245, a method for making shadow masks using low carbon Al-killed steel.

The present invention is to provide a further improvement of the photo-etching property and the press-formability than those of the steel of said patent application. That is, in the present invention the coil of an ordinary cold rolled Al-killed steel is forcibly decarburized in open coil annealing (referred to as "OCA" hereinafter) until solute carbon is decarburized up to an amount where the amount cannot be quantitatively confirmed by means of usual methods, that is, until the quench aging index (referred to as "QAI" hereinafter) becomes less than 3.0 Kg/mm$^2$.

Herein "QAI" is specified as follows:

$$QAI = \frac{W2 - W1}{S}$$

wherein,

W1: load (Kg) giving 10% tensile strain to the said decarburized material having been soaked at temperature of 500° C. for 10 minutes and subjected to a water cooling S: cross sectional area (mm$^2$) of a test piece when giving said 10% tensile strain W2: yield point load (Kg) provided by the said strain effected material aged at temperature of 100° C. for 4 hours.

DETAILED DESCRIPTION OF THE INVENTION

Figure 1:
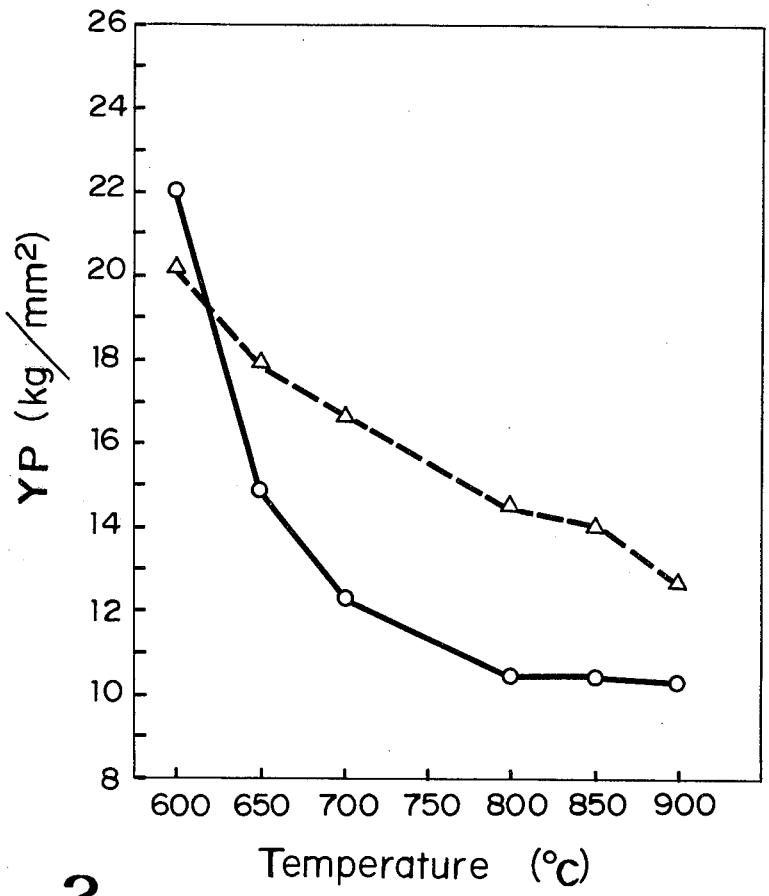
FIG. 1 is a graph showing the relation between yield point (Y.P) and annealing temperature.

The conventional coil of a cold rolled low carbon Al-killed steel is employed in a method of making material for shadow masks by the invention. At first, the cold rolled coil is forcibly decarburized in OCA until the QAI becomes less than 3.0 Kg/mm$^2$. This QAI is specified as follows:

$$QAI = \frac{W2 - W1}{S}$$

wherein,

W1: load (Kg) giving 10% tensile strain to the said decarburized material having been soaked at temperature of 500° C. for 10 minutes and subjected to a water cooling S: cross sectional area (mm$^2$) of a test piece when giving said 10% tensile strain W2: yield point load (Kg) provided by the said strain effected material aged at temperature of 100° C. for 4 hours.

The ordinary re-cold rolling after decarburization is followed by photo-etching, final annealing, levelling and pressing. Thus, the material for the shadow masks is produced. In the instant process, a levelling process may be omitted, and temper rolling may be undertaken before re-cold rolling.

The existing cold rolled Al-killed steel has the following composition: less than 0.1% C, less than 0.04% Si, less than 0.4% Mn, less than 0.015% P, less than 0.015% S, 0.02 to 0.06% Sol.Al, 0.0015 to 0.006% N, the balance being Fe and unavoidable impurities. The Al-killed steel referred to herein is meant the ordinary cold rolled Al-killed steel, and the chemical composition thereof prior to OCA is not different from the above mentioned composition.

By using a material which has been forcibly decarburized as noted hereinbefore, it is possible to carry out press forming with enough ease against either the phenomena of lack of decarburization which has often happened in the conventional OCA material, or carburization appearing on the way to the final annealing.

A reason why the present process employs Al-killed steel as a material for the shadow masks, is because Al-killed steel is very excellent in cleanliness in comparison with conventional rimmed steel, and solute nitrogen is fixed as AlN, which inevitably enters during the steel making procedure and causes high yield point (Y.P), large yield point elongation (Y.P.El) and QAI which are undesirable for a material for shadow masks and further precipitated AlN causes fine crystalline grains at the final annealing to produce uniform deformation at press forming. OCA was developed in the past for decarburizing rimmed steel and it had been a main method for decarburization annealing of rimmed steel for a long time. Lowering the carbon of rimmed steel to less than about 0.002%, is known as being dangerous since it, with high probability, causes generation of intergranular oxidation or causes cracks at secondary processing by extreme lowering of intergranular strength owing to overdecarburization. However, notwithstanding the foregoing technical common sense and because the yield point (Y.P) and the yield point elongation (Y.P.El) are preferably both as low as possible for press forming, the inventors conceptually departed from the conventional concept which depends upon ferrite grain size that the yield point elongation is controlled by crystalline grain size, and tried, similarly as to the said nitrogen, to provide ultra decarburization annealing with the object of extremely lowering solute carbon which causes solid solution hardening in the steel. At first, it was necessary to confirm the workability of the ultra low carbon Al-killed steel, and forcible decarburization was carried out to the extent that intergranular oxidation was recognized in the laboratory to investigate the workability. Table 1 shows the results together with those of rimmed steel.

TABLE 1

Test result of intergranular oxidized material

| Test pieces | A | B [C] | Immersing time (min) 0 | 5 | 10 | 20 | 30 |
|---|---|---|---|---|---|---|---|
| Al-killed steel | OK | C | 0 | 0 | 0 | 0 | 0 |
| Rimmed steel | OK | C | X | X | X | X | X |

Note:
A: Confirmation of grains in surface layer by microscope
B: Chemical analysis
C: Impossible to trace
OK: Confirmation
O: No cracking
X: Cracking With respect to the test pieces of rimmed and Al-killed steels, the amount of C in both were in the range wherein the amount could not be quantitatively determined in the chemical analysis. When rimmed steel was forcibly decarburized, it brought about intergranular oxidation, so that crystalline grains in the surface layer could be recognized by microscope examination without etching, and also in Al-killed steel. In this respect, there was no difference. Test pieces of the both having thickness of 0.65 mm and 90 mmϕ were drawn into cups of 40 mmϕ (drawing ratio: 2.25), and such drawn cups were subjected to an intergranular oxidation test wherein they were immersed in $HCl.H_2O$ solution of 1:1, followed by the following test. The grain boundary which is inherently weak is further weakened by the oxidation and is concentrated with stress by drawing and is selectively effected with corrosion by the subsequent immersion into HCl solution. The intergranular oxidation test is in general used as a test for enlarging the oxidation degree in the grain boundary. Results by this test are as shown in the above Table 1, from which it was confirmed that, being different from rimmed steel, the instant material was useful for shadow masks even when intergranular oxidation took place.

In the course of following studies, the OCA apparatus was provided with measuring machinery of high precision, and it was possible to forcibly decarburize a coil of ordinary cold rolled Al-killed steel up to the ultra low amount of carbon which could not be measured by machine analysis, chemical analysis or internal friction, basing on known equilibrium reaction $$C(in\alpha Fe)+H_2O=CO+H_2$$

$$K=Pco.PH_2/ac.PH_2O.$$

However, although the amount of carbon is so low as to be indeterminate there are some materials which cause stretcher strain (S.S) when the steel is pressed into shadow masks. Therefore, the inventors limited the steel materials to Al-killed steel, and devised the QAI as a quantitatively determinable method, because the amount of carbon was so low as to be indeterminable by conventional methods. One example of this method is as follows:

Decarburized Al-killed steel-making piece (JIS 5) for tensile test-heating.soaking of 500° C.×10 min-water quenching-10% tensile strain (W1)-measuring cross sectional area (S)-100° C.×4 h-tensile test (W2) wherein, W1: load (Kg) of 10% strain
S: cross sectional area ($mm^2$) after 10% strain
W2: load (Kg) of yield point $$QAI = \frac{W2 - W1}{S} \ (Kg/mm^2)$$

Table 2 shows the results obtained when the decarburization annealed steels which were different, respectively, in QAI as shown in "V", were subjected to pressing and the other processes for the production of shadow masks as disclosed hereinbefore.

TABLE 2

Results of QAI and pressing for shadow mask

| Check analysis Mn | Al | N | QAI ($Kg/mm^2$) V | W | Pressing results X | Y | Z |
|---|---|---|---|---|---|---|---|
| 0.27 to 0.32% | 0.024 to 0.045% | 0.0021 to 0.0048% | 5.5 | 7.4 | 20 | SS | 100 |
| | | | 5.3 | 7.0 | " | SS | 100 |
| | | | 4.5 | 6.8 | " | SS | 100 |
| | | | 3.8 | 6.5 | " | SS | 13 |
| | | | 3.0 | 6.1 | " | OK | 0 |
| | | | 1.8 | 4.3 | " | OK | 0 |
| | | | 1.2 | 3.7 | " | OK | 0 |
| | | | 0.9 | 4.0 | " | OK | 0 |
| | | | 0.6 | 3.4 | " | OK | 0 |
| | | | 0.3 | 2.1 | " | OK | 0 |

Notes:
V: After OCA
W: After final annealing
X: Number of sheets
Y: Contents of badness
Z: Badness (%)
Final Annealing 700° C. × 10 min (8 % $H_2$; dew point −30° C.) Cooling 1 hour As is seen from Table 2, it is necessary that QAI less than 3.0 $Kg/mm^2$ after the decarburization annealing to provide a practically useful pressed form for the manufacture of a shadow mask. Further, it was also found in this practical investigation that since the QAI just before pressing of the material on which the final annealing was carried out at the temperature of 700° C. was greater by about a maximum of 3.0 $Kg/mm^2$, the QAI after the final annealing should be less than about 6.1 $Kg/mm^2$. It is assumed that the large increase in the QAI just before pressing, is caused by to carburization in the intermediate stage still the final annealing by rolling oil at re-cold rolling, or slags of the photoetching, or by the atmosphere in the final annealing furnace (in general, by the makers of the cathode ray tubes for colour TV sets).

The conditions for obtaining QAI [condition for making solid solution (heating temperature and time), and the subsequent cooling condition, the amount of tensile strain at W1, and aging condition ] are only one example of the present invention. If these conditions are varied with respect to the same materials, the values of QAI to be obtained are different. That is, this stands, in principle, on the conception that if the carbon in the steel after the decarburization annealing is within the range where the amount is indeterminable and since, after the decarburization annealing, the steel is slowly cooled in the furnace until the furnace becomes cool, solute atoms (herein reference is made almost largely to carbon but it also includes nitrogen) precipitate by the fixed amount (exactly to say, lattice defects caused, e.g., by dislocation of lattice vacancy), and when this precipitating amount is subjected to re-heating.re-solid solution, and to the rapid cooling, the solute atoms are in solid solution, and therefore this condition may be expressed with a numerical value in a next strain aging measuring. Therefore, as is seen from this conception, for providing lower limits of the heating temperature, the soaking time and the rapidly cooling time, if the carbon content is higher depending upon the amount of solute carbon, it is necessary to use a higher heating temperature, a long soaking time and a more rapidly cooling time. The carbon being less than several ppm in the invention, water quenching of 200° C. to 700° C.×1 min to 1 h is preferable.

The present invention uses the QAI as a measuring means for quantitatively showing the extent of decarburization. Therefore, when using measuring means and selecting the decarburizing extent by varying one of more of the above mentioned conditions from those of the invention, and if said QAI were less than 3.0 Kg/mm$^2$ under the condition specified in this invention with respect to the decarburizing extent, it of course falls within the scope of this invention.

When the material for the shadow mask is produced under the above mentioned requirements, Y.P≦11.0 Kg/mm$^2$ and Y.P.E1≦1.0% can be obtained stably as the characteristic properties of the decarburization annealed material. After the final annealing, as shown in the graphs in FIGS. 1 and 2 Y.P≦15 Kg/mm$^2$ and Y.P.E1≦2.0% can be obtained when the annealing for a short period of time and at temperatures of more than about 650° C. This fact says that when the final annealing process is such as not to injure the shape of the shadow mask plate for example, such as a process wherein the mask plate is vertically suspended from one corner of the furnace, it is possible to omit the levelling process, since the initial Y.P.E1 is small.

Since the Y.P and Y.P.E1 of the obtained material are extremely low, the material is very advantageous in regard of uniform formability and shape-freezing property in comparison with the conventional material and is also very preferable to those requiring high precision, e.g., shadow masks for computer display.

Figure 2:
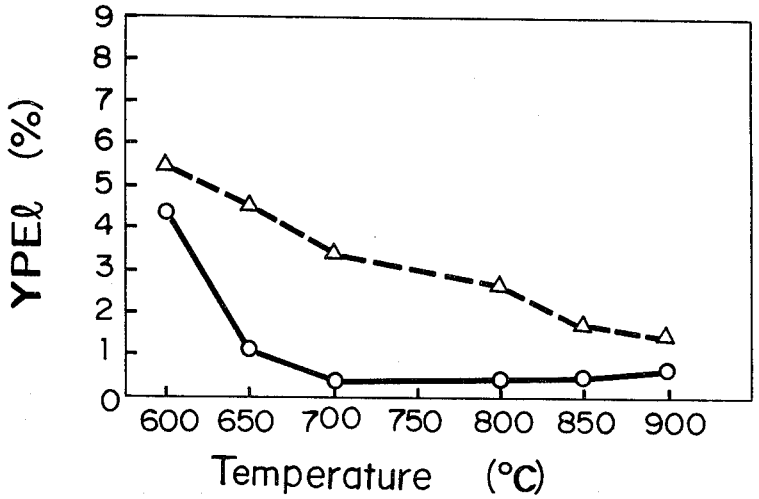
FIG. 2 is a graph showing the relation between yield point elongation (Y.P.El) and annealing temperature.

The graphs in FIGS. 1 and 2 show results when a cold rolled sheet of 0.65 mm thickness and ≦0.002% carbon was rolled to 0.15 mm in thickness, and subjected to final annealing of 700° C.×10 min within a non-decarburizing atmosphere, and followed with the tensile test (JIS 5) at room temperature, and wherein O reports the material processed by the method of this invention, and Δ reports the existing decarburized rimmed steel.

Examples of the invention are as follows:

Test pieces of five compositions designated "A" to "E", are cold rolled steel sheets treated under ordinary hot and cold rolling conditions. These materials A to E were washed using electrolytic cleaning methods. With respect to the materials A to C, forcible decarburization annealing was carried out until the QAI became less than 3.0 Kg/mm$^2$. With respect to the materials D and E, ordinary decarburization annealing was undertaken. Table 4 shows results of reliability of the materials. Subsequently, all the materials A to E were subjected to the re-cold rolling of 77% until the thickness became 0.15 mm, and to the photo-etching. The results thereof are also shown in Table 4. The photo-etched materials passed the final annealing of 700° C.×10min in the non-decarburizing atmosphere (92% $N_2$, 8% $H_2$, dew point −30° C.), after which, with respect to the materials A, those were divided into ones which were levelled and others which were not levelled. Table 5 reports results of both after pressing.

TABLE 3

| | | | Composition of test pieces, hot rolling temperatures and cold rolling conditions | | | | | | | | | | |
|---|---|---|---|---|---|---|---|---|---|---|---|---|---|
| | | | Check analysis values (%) | | | | | | | K | | N | |
| Samples | | | C | Si | Mn | P | S | Al | N | L | M | O | P |
| A | G | H | .05 | .01 | .15 | .012 | .013 | .059 | .0058 | 850 | 545 | .65 | 77 |
| B | | H | 4 | 1 | 27 | 12 | 15 | 24 | 21 | 862 | 550 | " | " |
| C | | H | 5 | 2 | 32 | 11 | 11 | 45 | 41 | 847 | 552 | " | " |
| D | I | H | 6 | 1 | 28 | 11 | 11 | 36 | 33 | 855 | 551 | " | " |
| E | | J | 6 | 1 | 34 | 12 | 12 | — | 15 | 848 | 605 | " | " |

Note:
G: The inventive materials
H: Al-killed steels
I: The conv. materials
J: Rimmed steels
K: Hot rolling temp.
L: Finishing (°C.)
M: Coiling (°C.)
N: Cold rolling
O: Thickness (mm)
P: Reduction (%)

TABLE 4

| | | Properties after decarburization annealing and Photo-etching results | | | | | | | |
|---|---|---|---|---|---|---|---|---|---|
| | | Material properties after OCA | | | | | | Photo-etching results | |
| Samples | | QAI (Kg/mm$^2$) | J [C] % | Y.P (Kg/mm$^2$) | YPE1 (%) | L | M | N (sheet) | O (%) |
| A | G | 0.3 | K | 9.8 | 0 | 8.5 | 300 | 0 | 0 |
| B | | 1.2 | " | 9.6 | 0.1 | 8.5 | " | 1 | 0.3 |
| C | | 3.0 | " | 10.2 | 0 | 8.5 | " | 0 | 0 |
| D | I | 6.2 | " | 13.1 | 2.6 | 8.5 | " | 0 | 0 |

TABLE 4-continued

| Samples | Properties after decarburization annealing and Photo-etching results | | | | | | | |
|---|---|---|---|---|---|---|---|---|
| | Material properties after OCA | | | | | Photo-etching results | | |
| | QAI (Kg/mm²) | J [C] % | Y.P (Kg/mm²) | YPE1 (%) | L | M | N (sheet) | O (%) |
| E | 7.3 | " | 14.3 | 4.3 | 6.5 | 300 × 4 | 113 | 9.4 |

Note: Holes (size) of photo-etching are not fixed
G: The inventive materials
I: The conv. materials
J: Chemical analysis
K: Impossible to trace
O: Undesirable defects
L: Ferrite grain size
M: Number of sample
N: Sheet number of undesirable defects due to non-metallic inclusions

TABLE 5

| Samples | | Annealing method | Pressing results | | | |
|---|---|---|---|---|---|---|
| | | | Leveller | Number of sample | Pressing results | Precision of holes after press |
| A | G | Suspending | Absent | 150 | Good | Very good |
| | | " | Present | " | " | " |
| B | | " | Absent | 300 | " | " |
| | | | Present | | | |
| C | | " | Absent | " | " | " |
| | | | Present | | | |
| D | I | " | Absent | " | Bad (SS appear) | Bad |
| | | | Present | | | |
| E | | " | Absent | 1087 | Good | Good |
| | | | Present | | | |

Note:
G: The inventive materials
I: The conventional materials

For making materials for shadow masks in accordance with the present invention, it is necessary to confirm whether the decarburization takes place to the intended extent. It is impossible to determine the decarburizing extent with the QAI specified in the invention, and feed it back to OCA, but it is practically possible to approach said extent by means of the weight of the material introduced in the furnace where the destined QAI was obtained in the past, the gas composition in the furnace, annealing temperatures, annealing conditions, CO% in the waste gas, the composition of the gas flowing into the furnace, otherwise by reproducing the operating conditions such as the flowing amount, or by keeping the tensile test piece between the coils for undertaking OCA, thereby to find out operating conditions by which no Y.P.E1 appears in the tensile test, or no Y.P arises on the Stress-Strain Chart. However, the above mentioned means are only an approximation and it will be required to check the coil after OCA with the QAI, and to return to Re-OCA those not satisfactorily decarburized.

As is seen from the above examples, the test pieces according to the invention were very little bad due to the non-metallic inclusions at etching. The good results were obtained, irrespectively of whether the levelling operation was carried out in the pressing process.

Figure 3:
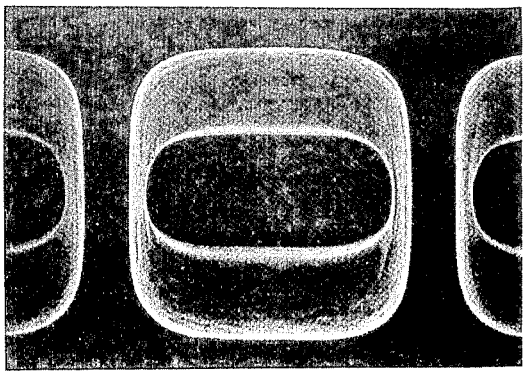
FIG. 3 is an electromicroscopic photograph of 120 magnifications showing an etching perforation of the material in accordance with the invention.
Figure 4:
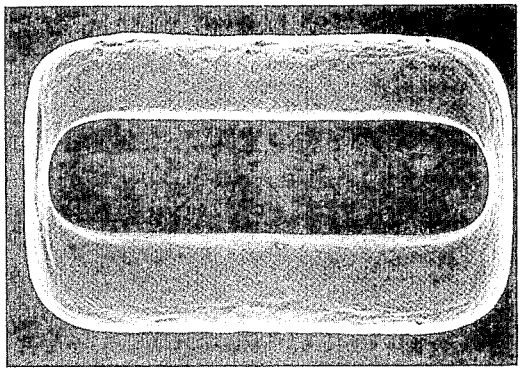
FIG. 4 is an electromicroscopic photograph of 120 magnifications showing an etching perforation of the material in accordance with the conventional process.

FIGS. 3 and 4 are the micro-photographs of 120 magnification showing the steel plates having large holes to the front sides and small holes in the opposite sides. FIG. 3 shows the instant material and FIG. 4 is the conventional one. As seen from the photographs, the decarburized Al-killed steel produced by the present invention has a pretty outer shape of the hole in comparison with that of the conventional decarburized rimmed steel, especially, the conical face running from one side to the other side is beautiful. In the conventional one of rimmed steel, inclusions can be recognized on the conical face. Therefore, the use of the material of the present invention also produces very excellent results in the etching finishing.

We claim:

1. A method of making material for shadow masks, comprising forcibly decarburizing a coil of cold rolled low carbon Al-killed steel which before said decarburization consists essentially of C: less than 0.1%
Si: less than 0.04%
Mn: less than 0.4%
P: less than 0.015%
S: less than 0.015%
Sol.Al: 0.02 to 0.06%
N: 0.0015 to 0.006%
the balance being Fe and unavoidable impurities;

by open coil annealing said steel until it is decarburized sufficiently so that the quench aging index QAI $$QAI = \frac{W2 - W1}{S}$$

wherein,

W1: load (Kg) giving 10% tensile strain to the said decarburized material having been soaked at a temperature of 500° C. for 10 minutes and subjected to water cooling, S: cross sectional area (mm²) of a test piece when giving said 10% tensile strain, W2: yield point load (Kg) provided by the said strain effected material aged at temperature of 100° C. for 4 hours;

is less than 3.0 Kg/mm², and then re-cold rolling said steel, photo-etching, final annealing in a non-decarburizing atmosphere and pressing to form shadow masks.

2. The method of claim 1, further comprising temper rolling said decarburized steel before re-cold rolling.

3. The method of claim 1 or 2 further comprising levelling before said pressing.

4. A method of making material for shadow masks, comprising forcibly decarburizing a coil of cold rolled low carbon Al-killed steel which before said decarburization consists essentially of C: 0.05%
Si: 0.01%
Mn: 0.15%
P: 0.012%
S: 0.013%
Sol.Al: 0.059%
N: 0.0058%
the balance being Fe and unavoidable impurities;

by open coil annealing said steel until it is decarburized sufficiently so that the quench aging index QAI $$QAI = \frac{W2 - W1}{S}$$

wherein,

W1: load (Kg) giving 10% tensile strain to the said decarburized material having been soaked at a temperature of 500° C. for 10 minutes and subjected to water cooling, S: cross sectional area ($mm^2$) of a test piece when giving said 10% tensile strain, W2: yield point load (Kg) provided by the said strain effected material aged at temperature of 100° C. for 4 hours;

is less than 3.0 $Kg/mm^2$, and then re-cold rolling said steel to a reduction of 77% and a thickness of 0.15 mm, photo-etching, and final annealing at temperature of 700° C. for 10 minutes in a non-decarburizing atmosphere, followed by pressing to form said shadow masks.

5. The method of claim 4, further comprising levelling before said pressing.

6. The method of claim 4 or 5, wherein said low carbon Al-killed steel before said decarburization has the following composition: 0.04% C, 0.01% Si, 0.27% Mn, 0.012% P, 0.015% S, 0.024% Sol.Al. 0.0021% N, and the balance being Fe and unavoidable impurities.

7. The method of claim 4 or 5 wherein said low carbon Al-killed steel before said decarburization has the composition 0.05% C, 0.02% Si, 0.32% Mn, 0.011% P, 0.011% S, 0.045% Sol.Al. 0.004% N, and the balance being Fe and unavoidable impurities.

* * * * *

UNITED STATES PATENT AND TRADEMARK OFFICE

CERTIFICATE OF CORRECTION

PATENT NO. : 4,427,460

DATED : January 24, 1984

INVENTOR(S) : Kenji ARAKI et al

It is certified that error appears in the above-identified patent and that said Letters Patent is hereby corrected as shown below:

| | |
|---|---|
| Column 3, line 1: | After "size" insert --and the fact--. |
| Column 4, line 39: | Before "less" insert --should be--. |
| Column 4, line 50: | Replace "stage still" with --stages till--. |
| Column 5, line 12: | Replace "long" with --longer--. |
| Column 6, lines 5 and 6: | Replace "in regard of" with --with regard to--. |

Signed and Sealed this

*Fifth* Day of *February 1985*

[SEAL]

*Attest:*

DONALD J. QUIGG

*Attesting Officer* *Acting Commissioner of Patents and Trademarks*